United States Patent [19]

Hagans

[11] Patent Number: 4,569,699

[45] Date of Patent: Feb. 11, 1986

[54] METHOD FOR PROVIDING A CORROSION RESISTANT COATING FOR MAGNESIUM CONTAINING MATERIALS

[75] Inventor: Patrick L. Hagans, Midland, Mich.

[73] Assignee: The Dow Chemical Company, Midland, Mich.

[21] Appl. No.: 731,823

[22] Filed: May 8, 1985

[51] Int. Cl.[4] ..... C23C 22/24; C23C 22/67

[52] U.S. Cl. ..... 148/6.2; 148/6.21; 148/6.27; 148/31.5

[58] Field of Search ..... 148/6.2, 6.21, 31.5, 148/6.27

[56] References Cited

U.S. PATENT DOCUMENTS

| | | | |
|---|---|---|---|
| 2,327,002 | 8/1943 | Thompson | 148/6 |
| 2,880,148 | 3/1959 | Evangelides | 204/35 |
| 3,917,517 | 11/1975 | Jordan et al. | 204/43 P |
| 4,107,004 | 8/1978 | Ward et al. | 204/51 |
| 4,208,452 | 6/1980 | Keithler | 427/204 |

FOREIGN PATENT DOCUMENTS

| | | |
|---|---|---|
| 34040 | 8/1981 | European Pat. Off. . |
| 44171 | 1/1982 | European Pat. Off. . |
| 1488381 | 10/1977 | United Kingdom . |
| 1498532 | 1/1978 | United Kingdom . |
| 1531056 | 11/1978 | United Kingdom . |

*Primary Examiner*—James R. Hoffman

*Attorney, Agent, or Firm*—J. H. Dickerson

[57] ABSTRACT

The invention is an improved method for depositing a chromite coating onto a magnesium-containing material comprising:

contacting the magnesium-containing material with a solution at least containing chromite ions and silicate ions for a time sufficient to deposit a corrosion resistant coating onto said magnesium-containing material;

wherein the concentration of chromite ions in the solution is from about 0.2 to about 1.2 moles per liter; the concentration of silicate ions is from about 0.1 to about 0.3 moles per liter; the pH of the solution is from about 1 to about 5; and the temperature of the solution is from about 25° C. to about 80° C.

14 Claims, No Drawings

METHOD FOR PROVIDING A CORROSION RESISTANT COATING FOR MAGNESIUM CONTAINING MATERIALS

BACKGROUND OF THE INVENTION

The invention relates to an improved method for providing a corrosive resistant coating to a magnesium-containing material. Specifically, the invention relates to an improved method for providing a chromium-silicon-containing, corrosive resistant coating to a magnesium-containing material.

Magnesium is a material that is commonly used in a variety of consumer and industrial materials such as automobile wheels and a variety of other automobile parts. However, magnesium is not entirely satisfactory for some purposes because it is subject to corrosion. A wide variety of corrosion resistant coatings have been developed for magnesium to make it more suitable for various uses.

Electrolytic coatings require a voltage to be applied between the substrate to be coated and a suitable counter electrode. The voltage acts as an external driving force to promote formation of the coating. Dip coatings do not require an external drawing force. In this case the substrate reacts directly with the coating solution.

It is known that protective layers of chromium oxides can be electrodeposited onto metal substrates to improve corrosion resistance. Such layers are known as chromium conversion coatings. At present, the production of chromium conversion coatings is carried out under acid conditions from a $Cr^{+6}$ electrolyte containing sulfuric or nitric acids. These coatings contain $Cr^{+6}$. These chromate coatings, however, are not entirely satisfactory because $Cr^{+6}$ is highly toxic and the disposal of spent solutions is environmentally difficult.

British Pat. No. 1,531,056 describes electrolytic techniques for the production of chromium-containing conversion coatings based on $Cr^{+3}$. Such coatings can be made containing substantially no $Cr^{+6}$ and have been referred to as "chromite" coatings.

European Patent Application 0034040 teaches a $Cr^{+3}$ conversion coating that can be applied by a nonelectrolytic method. A metal substrate is reacted with an aqueous solution comprising metal ions which are one or more of $Cr^{+3}$, $Fe^{+2}$, $Fe^{+3}$, or $Ni^{+2}$ ions in a concentration of up to 0.1 molar and an oxidizing agent to depolarize the reaction taking place at the surface of the substrate to be coated, whereby a coating is deposited on the surface of the substrate. Such coatings are referred to as "dip" coatings.

Dip coatings to deposit chromite conversion coatings onto the surface of metals are very useful and environmentally much safer than chromate coatings, however their deposition rate is relatively slow. A means for increasing the deposition rate would be highly desirable.

Likewise, the thickness to which chromite coatings can be applied is somewhat limited because the deposited coating blocks the deposition of additional thicknesses of coatings. It would be highly desirable to have a means to deposit thicker coatings of chromite onto metal substrates.

It is an object of the present invention to provide a method to rapidly deposit thick chromite dip coatings onto metal substrates.

SUMMARY OF THE INVENTION

The invention is an improved method for depositing a chromite coating onto a magnesium-containing material comprising:

contacting the magnesium-containing material with a solution at least containing chromite ions and silicate ions for a time sufficient to deposit a corrosion resistant coating onto said magnesium-containing material;

wherein the concentration of chromite ions in the solution is from about 0.2 to about 1.2 moles per liter; the concentration of silicate ions is from about 0.1 to about 0.3 moles per liter; the pH of the solution is from about 1 to about 5; and the temperature of the solution is from about 25° C. to about 80° C.

DETAILED DESCRIPTION OF THE INVENTION

It has been discovered that chromite dip coatings can be deposited thicker and more rapidly from chromite solutions which also contain a soluble silicate. The addition of silicate has two effects. First, it allows the coating times to be increased, which provides a thicker coating, and second, such a coating has been found to contain very little, if any magnesium, thus minimizing corrosion.

The soluble silicate used in the present invention may be sodium silicate, potassium silicate, or other water soluble silicates. Sodium silicate or potassium silicate are the preferred silicates because of their ready availability.

The preferred range for silicates is from about 0.05 to about 1 moles of silicate per liter of solution. At concentrations below about ~0.05 moles per liter of solution, the concentration of silicate is so low that the beneficial effect of the silicate is negligible. At higher concentrations, the silicate becomes insoluble and causes a precipitate to form in $Cr(NO_3)_3$ solution. Most preferred are concentrations from about 0.1 to about 0.3 moles silicate per liter of solution.

The chromite ions may be supplied from a variety of chromite compounds such as chromic acid reduced by hydrogen peroxide, by a basic solid salt or by a neutral salt such as $CrCl_3$, ($Cr(NO_3)_3$, $Cr_2(SO_4)_3$ or any other soluble $Cr^{+3}$ salts. Preferred sources for chromite ions is $Cr(NO_3)_3$ because of its high solubility and its ready availability.

The chromite ion concentration in the solution is preferably from about 0.2 to about 1.2 moles chromite per liter of solution. Concentrations below this range are ineffective because the concentration of chromite ions is so low that the beneficial effect of the chromite ions is minimal. Concentrations above this range are not preferred because an effective coating is not obtained.

The pH of the coating solution is preferably from about 1 to about 5. Below this range, too little silicate is incorporated into the coating. Above this range, too little chromite is incorporated into the coating. Preferably, the pH is from about 1.5 to about 4. Most preferred is a pH of from about 2 to about 3.

The solution is preferably at a temperature of from about 20° C. to about 90° C. Above this range, solution is near boiling and ineffective. Below this range, rate of coating application is very small. Preferably, the temperature of the solution is from about 30° C. to about 85° C. Most preferred is a temperature range of from about 75° C. to about 85° C.

The solutions of the present invention may be conveniently prepared by dissolving the silicate and the chromite compounds in an aqueous solution.

A variety of magnesium-containing materials may be used in the present invention including pure magnesium and alloys which contain magnesium as their major component. Such alloys include, for example, magnesium alloys of aluminum, zinc, and manganese. Preferably, the substrate is a magnesium alloy because the coating seems to work better on magnesium alloys especially with those that contain Al than on pure magnesium.

The time for contacting the chromite solution with the magnesium-containing substrate depends upon the temperature of the coating solution, the desired thickness of the coating required, and the composition of the coating solution. Usually, sufficiently thick coatings are obtained in from about 1 minute to about 12 minutes.

The coating of the present is a porous coating that is suitable for further processing such as painting. The thickness of the coating may be varied by adjusting the composition of the solution, the pH of the solution, by controlling the temperature of the solution and by controlling the time the solution is in contact with the substrate.

EXAMPLE

A 0.4 molar aqueous solution of $Cr(NO_3)_3$ was prepared. To it was added 7.5 grams of $Na_2SiO_3.9H_2O$ per 250 milliliters of solution.

A magnesium AZ91B alloy was sanded with 600 grin SiC paper and cleaned in a 10 weight percent aqueous caustic solution at 90° C. for about 10 minutes.

The chromite solution was heated to about 80° C. and mildly agitated. The magnesium alloy sample was dipped into the solution for about 7 minutes. It was removed, rinsed thoroughly with distilled water, and air dried.

I claim:

1. A method for depositing a chromite coating onto a magnesium-containing material comprising contacting the magnesium-containing material with a solution at least containing chromite ions and silicate ions for a time sufficient to deposit a corrosion resistant coating onto said magnesium-containing material and at a temperature of from about 25° to about 80° C., wherein (a) the concentration of chromite ions in the solution is from about 0.2 to about 1.2 moles of chromite per liter of solution;

(b) the concentration of the silicate ions in the solution is from about 0.05 to about 1.0 moles silicate per liter of solution; and (c) the pH of the solution is from about 1 to about 5.

2. The method of claim 1 wherein the silicate in the solution is from sodium silicate.

3. The method of claim 1 wherein the silicate in the solution is from potassium silicate.

4. The method of claim 1 wherein the concentration of the silicate in the solution is from about 0.1 to about 0.3 moles of silicate per liter of solution.

5. The method of claim 1 wherein the chromite ion are supplied from one or more compounds selected from the group consisting of chromic acid reduced by hydrogen peroxide, by a basic solid salt, or by $CrCl_3$; $Cr(NO_3)_3$; and $Cr_2(SO_4)_3$.

6. The method of claim 1 wherein the pH of the solution is from about 1.5 to about 4.

7. The method of claim 1 wherein the pH of the solution is from about 2 to about 3.

8. The method of claim 1 wherein the temperature of the solution is from about 30° to about 85° C.

9. The method of claim 1 wherein the temperature of the solution is from about 75° to about 85° C.

10. The method of claim 1 wherein the magnesium-containing material is pure magnesium.

11. The method of claim 1 wherein the magnesium-containing material is an alloy having magnesium as its major component.

12. The method of claim 1 wherein the magnesium-containing material is an alloy of magnesium which also contains aluminum.

13. The method of claim 1 wherein the solution is contacted with the magnesium-containing material for from about 1 minute to about 12 minutes.

14. The coated magnesium-containing material produced by the method of claim 1.

* * * * *